US007130573B2

(12) United States Patent
Nakamori

(10) Patent No.: US 7,130,573 B2
(45) Date of Patent: Oct. 31, 2006

(54) IMAGE FORMING APPARATUS

(75) Inventor: Tomohiro Nakamori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/409,472

(22) Filed: Apr. 9, 2003

(65) Prior Publication Data

US 2003/0194252 A1 Oct. 16, 2003

(30) Foreign Application Priority Data

Apr. 12, 2002 (JP) ..... 2002-109923

(51) Int. Cl.
*G03G 15/00* (2006.01)

(52) U.S. Cl. ..... 399/389; 399/394; 399/45

(58) Field of Classification Search ..... 399/45, 399/46, 389, 394, 396
See application file for complete search history.

(56) References Cited

U.S. PATENT DOCUMENTS

| | | | | |
|---|---|---|---|---|
| 5,334,817 | A | 8/1994 | Nakamori et al. | 219/492 |
| 5,455,659 | A | 10/1995 | Ishizu et al. | |
| 5,612,776 | A | 3/1997 | Machino et al. | 399/43 |
| 5,848,321 | A * | 12/1998 | Roh et al. | 399/45 |
| 5,925,889 | A | 7/1999 | Guillory et al. | 250/559.16 |
| 6,291,829 | B1 | 9/2001 | Allen et al. | 250/559.07 |
| 6,301,452 | B1 * | 10/2001 | Yoshizawa | 399/45 |
| 6,386,676 | B1 * | 5/2002 | Yang et al. | 347/19 |
| 6,421,139 | B1 | 7/2002 | Takami et al. | 358/1.2 |
| 6,449,445 | B1 | 9/2002 | Nakamori et al. | 399/69 |
| 6,496,661 | B1 | 12/2002 | Ando et al. | 399/22 |
| 6,497,179 | B1 * | 12/2002 | Allen et al. | 101/484 |

FOREIGN PATENT DOCUMENTS

| | | |
|---|---|---|
| EP | 0 911 699 A2 | 4/1999 |
| EP | 1 034 937 A2 | 9/2000 |
| JP | 10-265088 | 10/1998 |
| JP | 10/329984 | 12/1998 |
| JP | 11-271037 | 10/1999 |

OTHER PUBLICATIONS

European Search Report.

* cited by examiner

*Primary Examiner*—Hoang Ngo
(74) *Attorney, Agent, or Firm*—Fitzpatrick, Cella, Harper & Scinto

(57) ABSTRACT

In an image forming apparatus that judges the type of sheet by using an image pickup device, it is possible to read an image which does not blur and is excellent in precision even if the shutter period of time of the image pickup device is made long, and even in the case of providing a plurality of sheet feeding parts, it is possible to judge the type of sheet more inexpensively. An image read sensor, which is disposed downstream of a junction of a deck and a recording material tray and upstream of a pair of registration rollers on the transport path for the recording material, reads the image within a light irradiated region of the recording material by irradiating a light onto the surface of the recording material when the recording material which is fed to the transport path stops, and sets an image formation condition in accordance with a read output.

12 Claims, 4 Drawing Sheets

RECORDING SHEET A

RECORDING SHEET B

RECORDING SHEET C

RECORDING SHEET A

RECORDING SHEET B

RECORDING SHEET C

IMAGE FORMING APPARATUS

BACKGROUND OF THE INVENTION

1. Field of the Invention

The present invention relates to an image forming apparatus such as a copying machine, a laser printer or an ink jet printer, and more particularly to an image forming apparatus having a function of judging the type of sheet of a recording material by an image pickup device.

2. Related Background Art

Conventionally, the sheet type of a recording material used in the image forming apparatus of this type varies widely in thickness, basis weight, surface property, and material type. In the case where various recording materials are used to form an image under the same process conditions, there arises a problem where, although an excellent image is outputted on a recording material of a certain sort, the excellent image cannot be obtained on recording materials of other sorts.

In particular, with respect to the surface property of the recording material, the process conditions under which the output image becomes optimal (for example, a fixing temperature of an electrophotographic apparatus using a thermal fixing system) are largely different depending on whether the recording material has a smooth surface or the recording material has a rough surface (rough paper). Thus, a large difference in image quality occurs in the case where the image is outputted on different recording materials under the same process conditions.

For that reason, it has been proposed that a picture of a surface of the recording material is read by an image pickup device such as a CCD, the surface property of the recording material is detected by a given algorithm on the basis of the picked-up image, and the process conditions are automatically adjusted in accordance with the detected result as disclosed in, for example, Japanese Patent Application Laid-Open No. 11-271037.

However, the above-mentioned conventional image forming apparatus suffers from the following problems.

That is, in a structure where an image pickup device is disposed on a transporting path as disclosed in Japanese Patent Application Laid-Open No. 11-271037, the picture of the surface of the recording material is read while the recording material is being transported, and therefore it is necessary to set the shutter speed of the image pickup device high in order to obtain an excellent read picture without any blurring. Therefore, it becomes necessary to employ an image pickup device which is higher in performance and cost, and to increase the quantity of light which is irradiated onto the surface of the recording material since the shutter speed is made high. As a result, a user must bear the higher costs.

Also, in a structure where the image pickup device is disposed in a sheet feeding part, there is disadvantageous in that only the sheet type of a recording material on a specific sheet feeding part can be detected in the case of an image forming apparatus having a plurality of sheet feeding parts, or the image pickup devices of the same number as that of the sheet feeding parts needs to be disposed. Likewise, the user must bear the high costs in this case.

SUMMARY OF THE INVENTION

The present invention has been made in view of the above-mentioned problems, and therefore an object of the present invention is to provide an image forming apparatus in which the type of sheet is judged using an image pickup device (a picture taking device), and is capable of reading a fine picture of a surface of the sheet without any blurring even if a shutter period of time of the image pickup device is made long, and a method of controlling the image forming apparatus.

Another object of the present invention is to provide an image forming apparatus in which the type of sheet is judged by using an image pickup device, and is capable of judging the type of sheet more inexpensively even if a plurality of sheet feeding parts are provided thereto, and a method of controlling the image forming apparatus.

Still another object of the present invention is to provide an image forming apparatus, including:

a transporting part adapted to transport a recording material;

an image forming part adapted to form an image on the recording material which is transported by the transporting part;

a reading part adapted to read a picture of a surface of the recording material; and a judging part adapted to judge a type of the recording material on the basis of the picture of the surface of the recording material read by the reading part, in which the reading part is disposed along a transport path of the transporting part, and in which the judging part judges the type of the recording material on the basis of the picture of the surface of the recording material read by the reading part during a period of time where the recording material stops in a midway through the transport path.

Yet another object of the present invention is to provide an image forming apparatus, including:

a transporting part adapted to transport a recording material;

an image forming part adapted to form an image on an image bearing body;

a transfer part adapted to transfer the image on the image bearing body to a recording paper which is transported by the transporting part;

a synchronization controlling part adapted to restart the transport of the recording material after the recording material which is transported by the transporting part stops once in such a manner that the image on the image bearing body and the recording material are synchronous with each other;

a reading part adapted to read a picture of a surface of the recording material; and a judging part adapted to judge a type of the recording material on the basis of the picture of the surface of the recording material read by the reading part, in which the reading part is disposed along a transport path of the transporting part, and in which the judging part judges the type of the recording material on the basis of the picture of the surface of the recording material read by the reading part during a period of time where the synchronization controlling part stops the recording material.

Other objects, structures and advantages of the present invention will become apparent from the following detailed description and attached drawings.

DESCRIPTION OF THE PREFERRED EMBODIMENTS

Now, a description will be given in more detail of preferred embodiments of the present invention with reference to the accompanying drawings.

First Embodiment

First, a first embodiment of the present invention will be described below.

Figure 1:
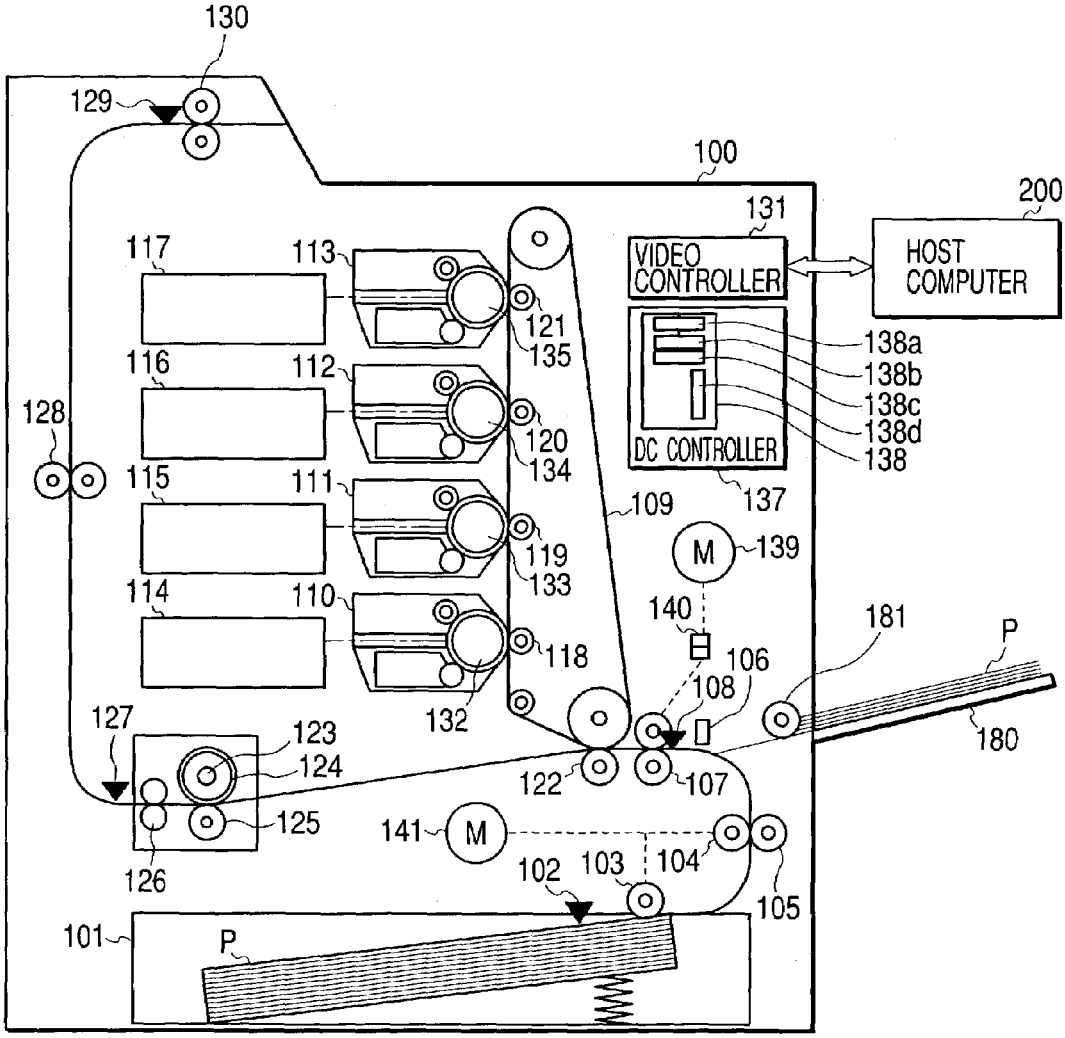
FIG. 1 is a cross-sectional view showing the structure of an image forming apparatus in accordance with the present invention.

FIG. 1 is a cross-sectional view showing the structure of an image forming apparatus in accordance with the present invention. FIG. 1 schematically shows the structure of a color laser printer (hereinafter referred to as "printer") 100 of an electrophotographic system. The printer 100 is connected to a host computer 200 which is an external device in this example.

The printer 100 includes a deck 101 that is a first sheet feeding part for receiving a recording material P therein. The printer main body is internally equipped with a deck sheet presence/absence sensor 102 that detects the presence/absence of the recording material P within the deck 101, a pickup roller 103 that draws out the recording material P from the deck 101, a deck sheet feed roller 104 that transports the recording material P which has been drawn out by the pickup roller 103, and a retard roller 105 that is paired with the deck sheet feed roller 104 for preventing the recording materials P from being doubly fed.

Reference numeral 180 denotes a recording material tray which is a second sheet feeding part, and a tray sheet feed roller 181 is disposed to draw out the recording material P on the tray 180. Then, an image read sensor 106 which will be described later is disposed downstream of the deck sheet feed roller 104 and the tray sheet feed roller 181.

Reference numeral 107 denotes a pair of registration rollers, and reference numeral 108 is a pre-registration sensor.

The recording material P which has been transported stops once by the pair of registration rollers 107 upon detection of the recording material P by the pre-registration sensor 108, and after a secondary transfer timing which will be described later is calculated, the recording material P is again transported.

Reference numeral 106 denotes an image read sensor. A light is irradiated onto the surface of the recording material P, a reflection light from the surface of the recording material P is converged and imaged, and the image on a specific area of the recording material P is read by the image read sensor 106.

In this example, the image read sensor 106 is disposed at a given position downstream of a junction of the first transport path from the recording material tray 180 and the second transport path from the deck 101 and upstream of the pair of registration rollers 107. A distance between the image read sensor 106 and the pair of registration rollers 107 is set to be shorter than the shortest length among the various recording material sizes which are processed by the printer 100 in the transporting direction.

In addition, an intermediate transfer belt (hereinafter referred to as "ITB") 109 is disposed downstream of the pair of registration rollers 107.

Then, toner images formed by an image forming part made up of process cartridges 110, 111, 112 and 113 and scanner units 114, 115, 116 and 117 for four colors (yellow Y, magenta M, cyan C, and black B) are sequentially superimposed on the ITB 109 by primary transfer rollers 118, 119, 120 and 121 (first transfer). As a result, a color image is formed on the ITB 109, and the color image is then transferred to the recording material P by the secondary transfer roller 122 (secondary transfer) and thereafter the recording material P is transported. The recording material restarts to be transported after stopping once by the pair of registration rollers 107 in such a manner that a leading edge of the color image on the ITB 109 and the leading edge of the recording material to be transported are made synchronous by the secondary transfer roller 122 (secondary transfer part).

Downstream of the secondary transfer roller 122 are disposed a fixing roller 124 having therein a heater 123 for heating to thermally fix a toner image that has been transferred onto the recording material P, a pair of pressure rollers 125, a pair of fixing and sheet discharge rollers 126 for transporting the recording material P from the fixing roller 124, a fixing and sheet discharge sensor 127 for detecting the transport state of the recording material P from the fixing part, a pair of transporting rollers 128 for transporting the recording material P from the fixing part, a sheet discharge sensor 129 for detecting the transport state of the recording material P in the sheet discharge part, and a pair of sheet discharge rollers 130 that discharge the recording material P.

Although not shown, each of the above-mentioned respective scanner units 114, 115, 116 and 117 is made up of a laser unit that emits a laser beam which is modulated on the basis of the respective image signals that are transmitted from a video controller 131 which will be described later, a polygon mirror for scanning the laser beams from the respective laser units on the respective photosensitive drums 132, 133, 134 and 135, a scanner motor and an imaging lens group.

Then, the above respective process cartridges 110, 111, 112 and 113 include the photosensitive drums 132, 133, 134 and 135 necessary for the known electrophotographic process, and charging rollers and developing rollers which are not shown, and are so structured as to be detachably attached to the printer 100.

Further, the video controller 131 develops the image data to bit map data upon receiving the image data sent from a personal computer 200 which is an external device, or the like, to thereby generate an image signal for image formation.

Reference numeral 137 denotes a DC controller which is a control part of the printer 100. The DC controller 137 is made up of a microcomputer (MPU) provided with a RAM 138*a*, a ROM 138*b*, a timer 138*c*, a digital input/output port 138*d* and so on, various input/output control circuits not shown, etc.

Reference numeral 139 denotes a main motor that rotationally drives the ITB 109 as well as the photosensitive drums 132, 133, 134, 135 and the respective transport system rollers such as the fixing roller 124 through a drive transmission system not shown, and rotationally drives the pair of registration rollers 107 through a clutch 140. Further, reference numeral 141 denotes a stepping motor which rotationally drives the pickup roller 103 and the deck sheet discharge roller 104.

Figure 2:
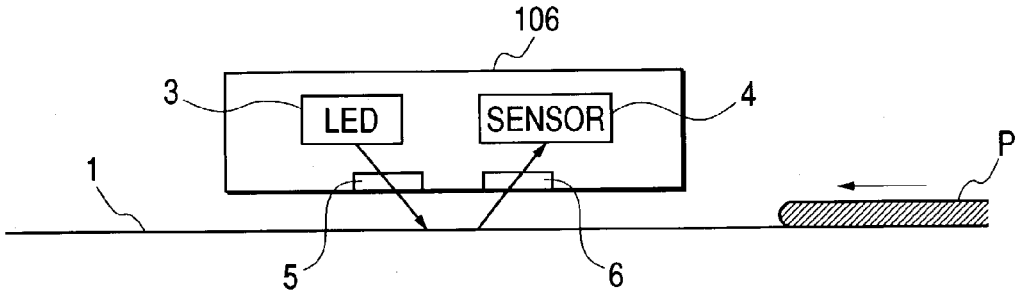
FIG. 2 is an explanatory diagram showing the structure of an image read sensor in accordance with embodiments of the present invention.

Subsequently, the structure of the image read sensor 106 will be described with reference to FIG. 2. The image read sensor 106 includes an LED 3 serving as light irradiation means, a CMOS sensor 4 serving as read means, lenses 5 and 6 which are imaging lenses, and so on. Then, a light from the LED 3 as a light source is irradiated onto the surface of a recording material transport guide 1 or the surface of the recording material P on the recording material transport guide (recording material transport path) 1 through the lens 5.

Further, a reflection light from the recording material P is converged by the lens 6 and imaged on the CMOS sensor 4. With this structure, the surface image of the recording material transport guide 1 or the recording material P is read. In this embodiment, the LED 3 is so arranged as to irradiate the LED light onto the surface of the recording material P obliquely with a given angle as shown in FIG. 2.

FIGS. 3A to 3F are diagrams showing a relationship between the surface of the recording sheet P which has been read by the CMOS sensor 4 of the image read sensor 106 and an example in which the output from the CMOS sensor 4 is digitized to 8×8 pixels, respectively. The digitizing process is conducted by transforming the analog output from the CMOS sensor 4 to pixel data of 8 bits by an A/D converter (not shown) serving as conversion means.

Figure 3A:
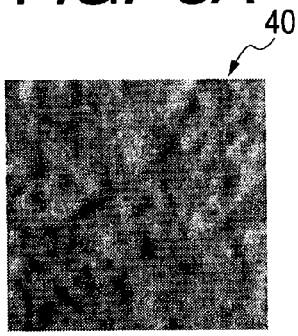
FIGS. 3A, 3B, 3C, 3D, 3E and 3F are diagrams showing a relationship between the surface of a recording material and a digital processing example, respectively.
Figure 3B:
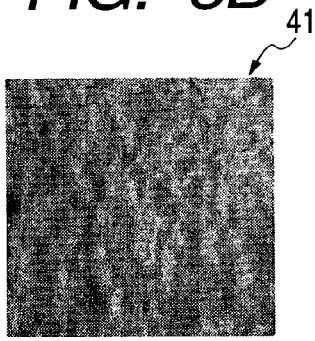
Figure 3C:
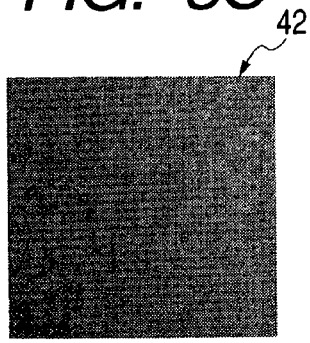
Figure 3D:
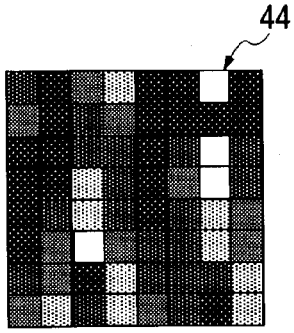
Figure 3E:
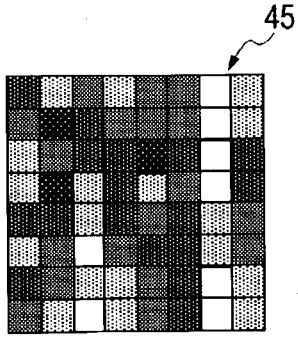
Figure 3F:
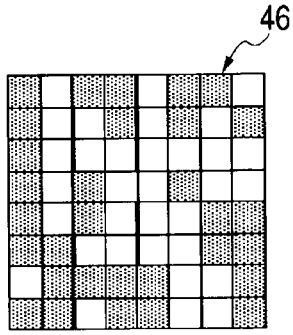

FIG. 3A shows an enlarged image on the surface of a recording sheet A which is a so-called "rough paper" whose surface is relatively rough in paper fiber, FIG. 3B shows an enlarged image on the surface of a recording sheet B which is a so-called "plain paper" which is commonly used, and FIG. 3C shows an enlarged image on the surface of a recording sheet C which is a gloss paper whose paper fibers have been sufficiently compressed, respectively. Then, those images which are read by the CMOS sensor 4 are digitized into images shown in FIGS. 3D, 3E and 3F.

In this manner, the images of the surface are different depending on the sheet type of the recording materials. This is a phenomenon that occurs mainly because the fiber state on the surface of the paper is different. Therefore, as described above, the image obtained by reading the recording material surface by the CMOS sensor 4 and digitizing the recording material surface can be judged by the surface state of the paper fiber of the recording material.

Figure 4:
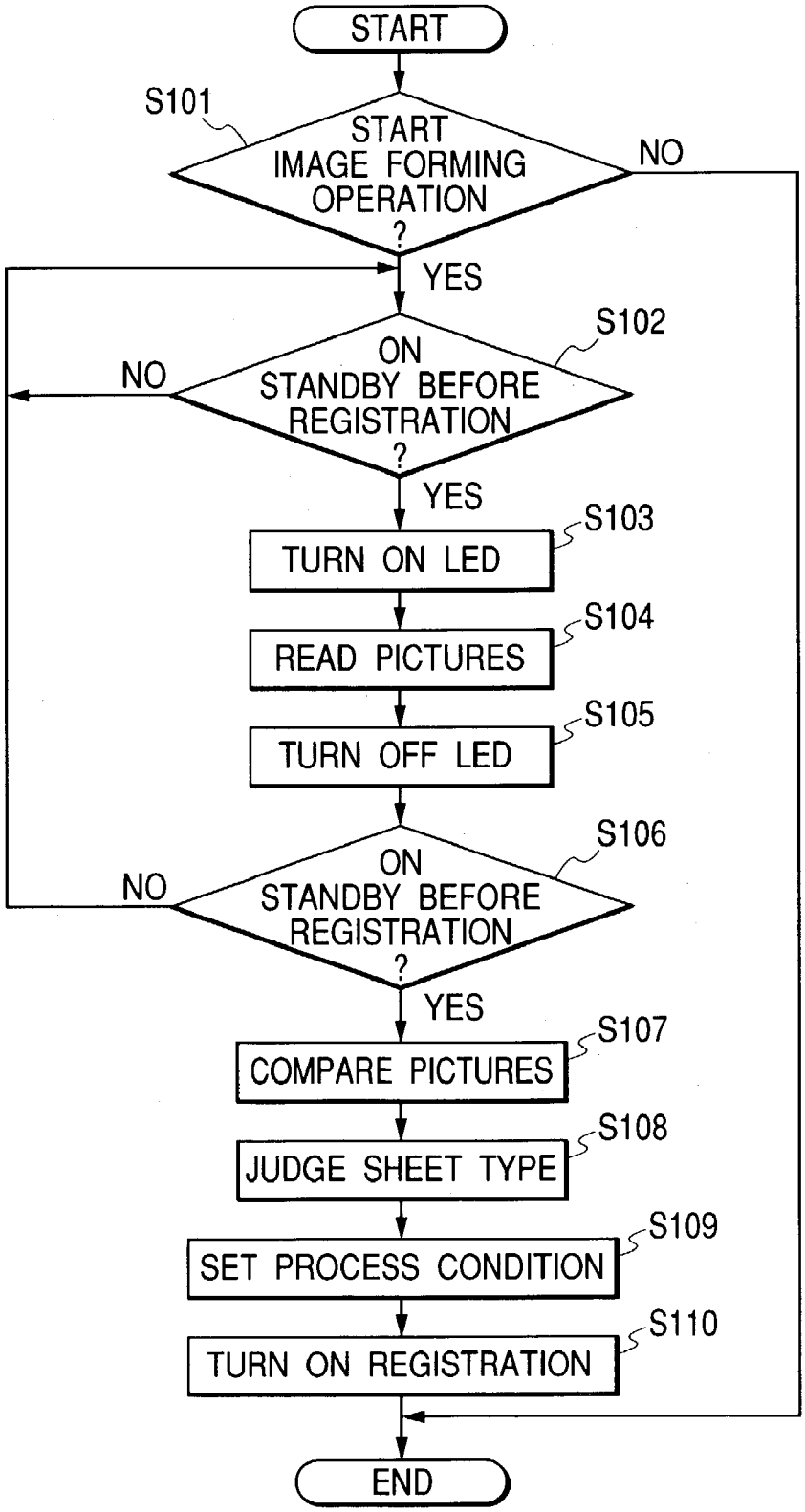
FIG. 4 is a flowchart showing the operation of a first embodiment of the present invention.

A description will now be given of the control operation by the MPU 138 disposed in the DC controller 137 serving as read timing control means in accordance with this embodiment with reference to a flowchart shown in FIG. 4.

First, in a step S101, it is judged whether an image forming operation starts, or not, and in the case where the image forming operation starts, after the image forming operation on the recording material P starts, the recording material is transported and arrives at the pair of registration rollers 107, and waits until it becomes in a temporary stop state (hereinafter referred to as "standby before registration) for synchronous adjustment of the registration in a step S102. Whether the recording material P arrives at the pair of registration rollers 107, or not, is judged by monitoring the pre-registration sensor 108 by the DC controller 137. Then, when the operation becomes on standby before registration, the LED 3 turns on in a step S103, and the image of the recording material P is read by the CMOS sensor 4 in a step S104.

Then, after the LED 33 turns off in a step S105, it is judged again in a step S106 that the recording material P is on standby before registration. This is because the image is again read in the case where the recording material P becomes in a transporting state during reading the image with the result that the image cannot be excellently read (blurring of the read image, or the like). Then, in the case where the recording material is on standby before registration in a step S106, an image comparison operation which will be described later is conducted in a step S107, and the type of sheet is judged on the basis of the image comparison operation result in a step S108.

Then, the process condition is set in accordance with the judged type of sheet in a step S109, the registration roller is rotated in a step S110, and the transportation of the recording material restarts. On the recording material whose transportation restarts afterward, is transferred an image on the ITB 109 in the secondary transfer part (secondary transfer roller 122), and the image is fixed on the recording material before the recording material is discharged.

There have been known various techniques of setting the process condition in accordance with the type of sheets. For example, in the case where it is judged that the recording material is OHT, when the fixing temperature increases as compared with the plain paper, an excellent fixing property is obtained. Also, the temperature of the fixing roller 124 is controlled in such a manner that if the type of sheet is, for example, the recording material A shown in FIGS. 3A to 3F, whose surface paper fibers are rough is used, the fixing temperature is set to be higher, and if the type of sheet is the recording material C whose surface paper fibers are smooth, the fixing temperature is set to be lower.

Now, a method of the image comparison operation will be described. In the image comparison operation, the pixel Dmax of the maximum density and the pixel Dmin of the minimum density are led from the result of reading the images at plural portions of the recording material surface. Then, this is executed for each of the read images, and an average processing is conducted. That is, in the case where the type of sheet whose surface paper fibers are rough as in the recording material A is used, the shadow of the fibers largely occurs. As a result, because a difference between a light portion and a dark portion is largely exhibited, Dmax−Dmin becomes large. On the other hand, in the case of the surface of the recording material C, the shadow of the fibers is small, and Dmax−Dmin becomes small. This comparison makes it possible to judge the type of sheet of the recording material.

Because the above-mentioned image comparison operation is required to conduct the sampling process of the image from the CMOS sensor 4 and the gain and filtering operation process at a real time, it is desirable to use a digital signal processor.

As described above, in this embodiment, in the image forming apparatus that judges the type of sheet by using the image pickup device such as the CMOS sensor 4 or the CCD sensor, since the LED 3 and the CMOS sensor 4 are arranged on the recording material transport guide 1, and the operation of reading the image of the recording material surface by the CMOS sensor 4 is conducted at the time of stopping the recording material P, the image that does not blur and is excellent in precision even if the shutter period of time of the image pickup device is made long.

Also, in the case of including a plurality of paper feed parts, the LED 3 and the CMOS sensor 4 are disposed downstream of the junction of the recording material transport paths from the respective paper feed parts, thereby being capable of judging the type of sheet more inexpensively.

Second Embodiment

Next, a second embodiment of the present invention will be described below. The same structures as those in the first embodiment shown in FIGS. 1 to 4 are designated by like references, and their description will be omitted.

Figure 5:
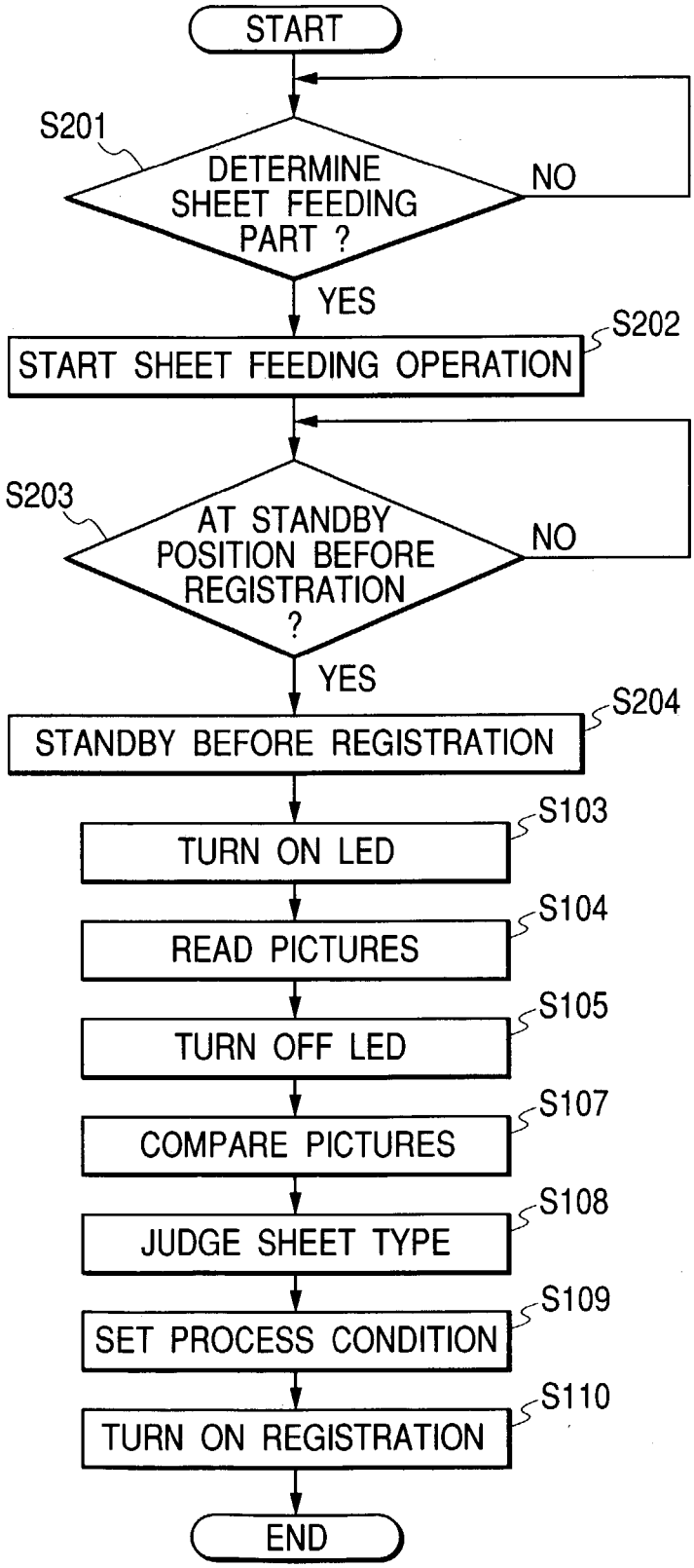
FIG. 5 is a flowchart showing the operation of a second embodiment of the present invention.

FIG. 5 is a flowchart showing the control operation by an MPU 138 disposed in a DC controller 137 serving as read timing control means in accordance with this embodiment.

A difference from the first embodiment resides in that the image read operation does not wait until the recording material P stops on standby before registration since the image forming operation starts, but at a time point where the paper feed part that feeds the recording material P is decided in a step S201; the recording material P is fed in a step S202, the recording material P is transported to a standby position before registration in a step S203, the recording material P is made on standby before registration in a step S204, and a sequence of operations including the operation of turning on the LED in the step S103 to the operation of judging the sheet type in the step S108 are conducted.

The above control makes it possible to set a period of time during which the recording material P is on standby before registration to be longer, and therefore it is possible to forcedly stop the recording material P before registration at the time of reading the image.

As described above, in this embodiment, the LED 3 and the MOS sensor 4 are disposed on the recording material transport guide 1, and the transportation of the recording material P stops at the time of reading the image of the recording material surface by the CMOS sensor 4, to thereby obtain the same effects as those in the above above-mentioned embodiment.

It is needless to say that it is possible to conduct the normal image forming operation from a state where the recording material P is on standby before registration after the above process, and therefore their description will be omitted.

As was described above, according to the present invention, in the image forming apparatus that judges the sheet type by using the image pickup device, it is possible to read an image that-does not blur and is excellent in precision even if the shutter period of time of the image pickup device is made long.

Also, even in the case of providing a plurality of sheet feeding parts, it is possible to judge the sheet type more inexpensively.

The above description was given with reference to several preferred embodiments, but the present invention is not limited to those embodiments, and it is apparent that various modifications and applications are enabled within the scopes of the claims.

What is claimed is:

1. An image forming apparatus, comprising:

a transporting unit adapted to transport a recording material;

an image forming unit adapted to form an image on an image bearing member;

a transfer unit adapted to transfer the image on the image bearing member to a recording material which is transported by the transporting unit;

a synchronization controlling unit adapted to stop the recording material which is transported by the transporting unit and to restart the transport of the recording material to synchronize the recording material with the image on the image bearing member;

a reading unit disposed along a transport path of said transporting unit, adapted to read a surface of the recording material as a picture consisting of plural pixels each indicating density degree; and a judging unit adapted to judge the type of a recording material on the basis of the picture of the surface of the recording material read by the reading unit, wherein the judging unit judges the type of the recording material on the basis of the picture of the surface of the recording material read by the reading unit during a period of time where the synchronization controlling unit stops the recording material.

2. An image forming apparatus according to claim 1, wherein said reading unit comprises a light emitting unit that irradiates a light onto the recording material, and a light receiving unit that receives a reflection light from the recording material.

3. An image forming apparatus according to claim 1, wherein said judging unit judges the type of the recording material by calculating surface smoothness of the recording material on the basis of the picture of the surface of the recording material read by the reading unit.

4. An image forming apparatus according to claim 1, wherein the image bearing member comprises an intermediate transfer member.

5. An image forming apparatus according to claim 1, further comprising control means for controlling a process condition on the basis of a judging result of the judging unit.

6. An image forming apparatus according to claim 1, further comprising a first sheet feeding unit and a second sheet feeding unit, wherein the reading unit is disposed downstream of a junction of the transport path from the first sheet feeding unit and the transport path from the second sheet feeding unit.

7. An image forming apparatus, comprising:

a transporting unit adapted to transport a recording material;

an image forming unit adapted to form an image on an image bearing member;

a transfer unit adapted to transfer the image on the image bearing member to the recording material which is transported by the transporting unit;

a synchronization controlling unit adapted to stop the recording material which is transported by the transporting unit and to restart the transport of the recording material to synchronize the recording material with the image on the image bearing member;

a reading unit disposed along a transport path of said transporting unit, adapted to read a surface of the recording material as a picture consisting of plural pixels each indicating density degree; and a setting unit adapted to set an image forming condition on the basis of the picture of the surface of the recording material read by the reading unit, wherein the setting unit sets the image forming condition on the basis of the picture of the surface of the recording material read by the reading unit during a period of time where the synchronization controlling unit stops the recording material.

8. An image forming apparatus according to claim 7, wherein said reading unit comprises a light emitting unit that irradiates a light onto a recording material, and a light receiving unit that receives a reflection light from the recording material.

9. An image forming apparatus according to claim 7, further comprising a judging unit for judging the type of the recording material by calculating surface smoothness of the recording material on the basis of the picture of the surface of the recording material read by the reading unit.

10. An image forming apparatus according to claim 7, wherein said setting unit sets a process condition on the basis of the picture of the surface of the recording material.

11. An image forming apparatus according to claim 7, further comprising a first sheet feeding unit and a second sheet feeding unit, wherein the reading unit is disposed downstream of a junction of a transport path from the first sheet feeding unit and a transport path from the second sheet feeding unit.

12. An image forming apparatus according to claim 7, wherein the image bearing member comprises an intermediate transfer member.

* * * * *

UNITED STATES PATENT AND TRADEMARK OFFICE

CERTIFICATE OF CORRECTION

PATENT NO. : 7,130,573 B2
APPLICATION NO. : 10/409472
DATED : October 31, 2006
INVENTOR(S) : Tomohiro Nakamori It is certified that error appears in the above-identified patent and that said Letters Patent is hereby corrected as shown below:

ON THE TITLE PAGE, AT ITEM (56), RC:
Foreign Patent Documents, "JP 10/3229984 12/1998" should read --JP 10-329984 12/1998--.

COLUMN 2:
Line 30, "in a" should be deleted.

COLUMN 7:
Line 32, "above" should be deleted.
Line 37, "their" should read --its--.
Line 42, "that-does" should read --that does--.

Signed and Sealed this

Twenty-fourth Day of April, 2007

JON W. DUDAS
*Director of the United States Patent and Trademark Office*